US007847687B2

(12) United States Patent
Schulak et al.

(10) Patent No.: US 7,847,687 B2
(45) Date of Patent: Dec. 7, 2010

(54) CONTEXT-SENSITIVE ALERTS

(75) Inventors: Andrew Harper Schulak, Philadelphia, PA (US); Evan Mintz Lennick, Valley Forge, PA (US)

(73) Assignee: Accenture Global Services Limited, Dublin (IE)

( * ) Notice: Subject to any disclaimer, the term of this patent is extended or adjusted under 35 U.S.C. 154(b) by 596 days.

(21) Appl. No.: 11/676,064

(22) Filed: Feb. 16, 2007

(65) Prior Publication Data

US 2008/0198005 A1 Aug. 21, 2008

(51) Int. Cl.
*G08B 21/00* (2006.01)

(52) U.S. Cl. ..... 340/540; 340/568.1; 340/539.32; 340/573.1

(58) Field of Classification Search ..... 340/540, 340/541, 545.3, 545.4, 550, 568.1, 586, 539.32, 340/539.1, 573.1; 702/179, 180, 187
See application file for complete search history.

(56) References Cited

U.S. PATENT DOCUMENTS

| | | | | |
|---|---|---|---|---|
| 5,263,118 | A * | 11/1993 | Cornelison | 704/200 |
| 6,329,904 | B1 * | 12/2001 | Lamb | 340/286.02 |
| 7,194,353 | B1 * | 3/2007 | Baldwin et al. | 701/206 |
| 7,283,045 | B1 * | 10/2007 | Manz | 340/506 |
| 7,299,152 | B1 * | 11/2007 | Moritz | 702/179 |
| 2004/0220753 | A1 * | 11/2004 | Tabe | 702/32 |
| 2006/0047742 | A1 | 3/2006 | O'Neill et al. | |
| 2006/0085367 | A1 * | 4/2006 | Genovese | 706/44 |
| 2006/0278069 | A1 * | 12/2006 | Ryan | 86/50 |
| 2007/0116189 | A1 * | 5/2007 | Clawson | 379/37 |
| 2007/0234892 | A1 * | 10/2007 | Goldman et al. | 89/1.13 |
| 2009/0204551 | A1 * | 8/2009 | Wang et al. | 705/400 |

* cited by examiner

*Primary Examiner*—Daniel Previl

(57) ABSTRACT

Real-time, geo-targeted and context-sensitive alerts are provided based on a stated objective. Factual information is collected over time. When a user needs the information, the user registers an objective and a geographic location. The factual information is scored for relevance, based on how closely the information fits the user's geographic location, and how relevant the information is to the user's stated objective. The most relevant information, as determined based on score, is pushed to the user in real-time.

21 Claims, 4 Drawing Sheets

| Object | Location | Time |
|---|---|---|
| 301 | (1,3) | 1427 |
| 302 | (2,3) | 1428 |
| 301 | (2,5) | 1434 |
| 301 | (7,6) | 1445 |
| 302 | (1,1) | 1447 |

CONTEXT-SENSITIVE ALERTS

BACKGROUND

Application software currently exists that can provide useful data to its users based on geographic information. However, the data provided is usually visually based (e.g., provided in the form of showing the location of entities on a map), and of a historical nature (e.g., a particular entity was located at a certain point at a certain time). While this information is useful in allowing users to visually understand the geographical relationships between entities, it is of a historical and generic nature. Historical, because the data being viewed is data that was collected in the past and is unchanging. Generic, because the view of the data is not tailored for any one person and their interests.

These types of systems are excellent tools for people working in situations where time and safety are of no concern. However, they are inadequate tools for people whose situations are time-critical, and whose environments are unstable and possibly hostile.

People in these situations do not have the time to perform exhaustive data searches and to decide on and enter the data necessary to execute. It would be desirable for a system to push geo-targeted and context-sensitive information to users that is critical to the users' task at hand.

SUMMARY

Alerts are provided to a user based on information that is deemed particularly relevant to that user. A user, who typically carries a network-enabled device, registers a statement of that user's objective. Data about facts and circumstances is provided to a server. Those data are scored based on a number of factors, such as how well a given piece of data matches the user's objective, how old the data is, and other factors. Data that are deemed to be particularly relevant to the user's objective—e.g., data whose score, or combination of scores, is particularly high—are pushed to the user in the form of an alert. Thus, large amounts of data that are irrelevant to the user—either for geographic reasons (e.g., the data relates to an object or event far from the user) or for substantive reasons (e.g., the data has little to do with the user's objective)—are weeded out, thereby allowing the user to receive, and to focus on, only the most relevant information.

For example, if a user is a soldier on patrol for Improvised Explosive Devices (IEDs), the user can register, as an objective, the fact that he or she is on patrol for IEDs in a particular geographic area. A database can store information about past IED detonations, based on time and location. Much of this information is irrelevant to the user, either because it is old, or because it relates to events that took place far from the user's patrol. The data in the database can be scored based on such factors as where the user is patrolling, how old the data is, and what the objective of the user's patrol is. Based on the scores, the most relevant information can be pushed to the user in the form of an alert.

In one example, the subject matter described herein includes a system that provides selected information to a device, the system comprising: one or more processors; one or more data remembrance devices; a module that comprises instructions that are stored in said one or more data remembrance devices and that are executable on said one or more processors, the module receiving a description of an objective to be performed by a person and further receiving data relating to circumstances that are changeable with passage of time, the module continually evaluating said data to assign changeable scores to said data based on one or more first criteria, wherein said scores are changeable based on changes in said circumstances, the module pushing, to a device associated with said person, information based on that portion of said data whose scores satisfy a second criterion.

In another example, the subject matter described herein comprises either a method, or one or more computer-readable storage media having computer-executable instructions to perform a method, where the method comprises: receiving a description of an objective to be performed by a person; receiving data relating to circumstances that are changeable with passage of time; continually evaluating said data to assign changeable scores to said data based on one or more first criteria, wherein said scores are changeable based on changes in said circumstances; and pushing, to a device associated with said person, information based on that portion of said data that whose scores satisfy a second criterion.

Other features are described below.

DETAILED DESCRIPTION

Overview

The subject matter described herein provides context-sensitive alerts based on a stated objective. Raw data can be collected that describes a current or past situation—e.g., data about the locations of objects. For any given purpose, much of this data is likely to be irrelevant, so it is desirable to filter the data in some way and push only the most relevant data to an interested user.

For example, a soldier may be on patrol in a hostile urban setting. His group may be searching for insurgents related to a string of recent IED attacks. Over the course of his tour of duty, and even before then, hundreds of thousands of pieces of information have been collected. Some of the collected data may be accurate, and some of it is not. Some of the data is relevant to the soldier's mission; likely, most of it is not.

While on patrol, the subject matter described herein provides the solder, in real-time, a mix of geo-targeted and context-sensitive historical data (e.g., locations of known detonated IEDs in his area as he moves through different areas), and real-time data (e.g., a covert operative three blocks away from the soldier just reported seeing suspicious individuals with an "odd looking apparatus" and some cell phones in the area).

With reference to the drawings, example embodiments are now described.

Example System for Sending Context-Sensitive Alerts

Figure 1:
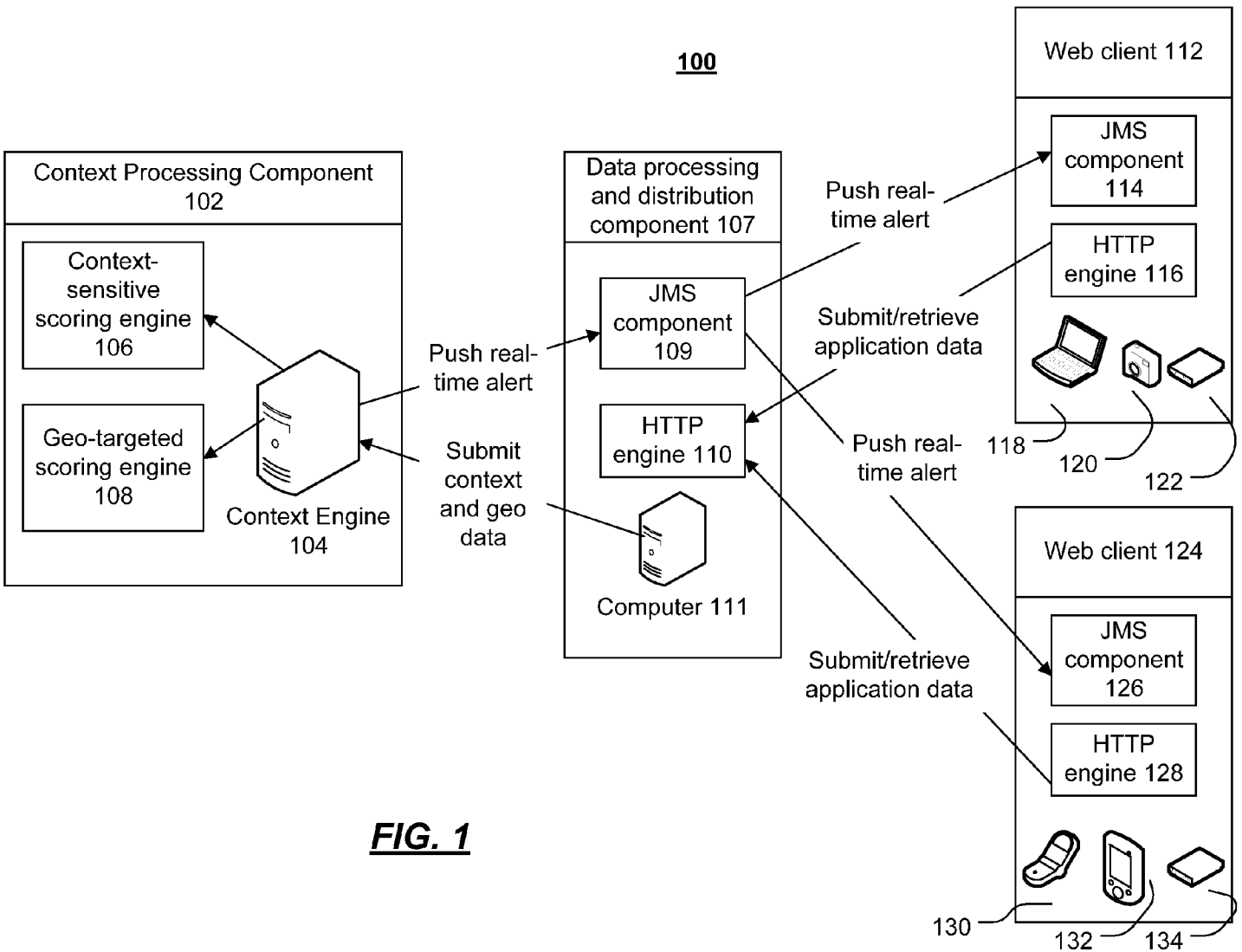
FIG. 1 is a block diagram of an example system in which context-sensitive alerts can be generated and provided.

FIG. 1 shows an example distributed environment 100 in which information, such as context-sensitive alerts, may be generated and provided. System 100 includes a context processing component 102, a data processing and distribution component 106, and one or more clients 112 and 124.

Context processing component 102 includes a context engine 104, which receives context and geographic data, and provides real-time alerts. The manner in which context and geographic data is received, and in which real-time alerts are provided, is more particularly described below. Context engine may comprise software running on a computing system. A function of context engine 104 is to receive factual information (such as geographic locations of people, object, and events), and context information (such as information that describes, or from which it can be inferred, what sort of alerts or other information would be of most use to certain people), and generates such alerts or other information based on the information it has received.

Context engine 104 may be assisted by scoring engines, such as context sensitive scoring engine 106 and geo-targeted scoring engine 108. Scoring engines 106 and 108 are shown in FIG. 1 as being components separate from context engine 104, although it will be understood that the subject matter described herein is not limited to any particular separation of such components. Scoring engines 106 and 108 may be part of a single context engine program that runs on a single computer; at the other end of the spectrum, context engine 104 and scoring engines 106 and 108 may be separate programs that run on either a single computer or on separate computers. For conceptual simplicity, context engine 104 and scoring engines 106 and 108 are all shown in FIG. 1 as separate components.

Scoring engines 106 and 108 may score certain information based on its perceived relevance. A goal of such scoring is to allow context engine to determine which material is most relevant to certain people by considering the scores of the information. For example, geographic information about the location of objects that are likely to move may be given a higher or lower score based on the age of the information—e.g., information about the location of a car may be given a high score if the information is one minute old, and a low score if the information is six hours old. As another example, information may be given a high or low score based on how well the information fits the context that has been communicated to context engine 104—e.g., if the context information indicates that a particular person who needs to receive alerts is a soldier who is going out on patrol for IEDs, that person may be especially interested in the locations of recent explosions, but less interested in the current location of aircraft. It will be understood that the score associated with a particular piece of information need not be static, but rather can change over time—e.g., the score for an item of location information may be high when the information is new, but may become lower as the information becomes older, since old information about a movable object's location may become less and less relevant over time if the object could have moved.

Data processing and distribution component 107 serves as a clearinghouse for information that is being passed back and forth between context processing component 102 and clients 112 and 124.

Data processing and distribution component 106 may comprise a Java Message Service (JMS) component 109 and a Hypertext Transfer Protocol (HTTP) engine 110, which may be implemented on a computing device 111. JMS component 109 and HTTP engine 110 are examples of components that can be used to send and receive various types of messages. Which component is used depends on the capabilities of the entity with which data processing and distribution component 107 is communicating. For example, if data processing and distribution component 107 communicates with a standard web browser, then HTTP engine 110 may be used. Alternatively, if data processing and distribution component 107 communicates with a Java-enabled component, then JMS component 109 may be used.

Clients 112 and 124 are examples of entities that may provide context information to context processing component 102, and that may receive alerts or other information from context processing component 102.

In the example of FIG. 1, client 112 is a web client, which may exist on a device such as computer 118 or camera 120, either of which may make use of a communications device such as modem 122 in order to enable web client 112 to communicate over a network such as the Internet. Web client 112 may employ a JMS component 114 and/or an HTTP engine 116 to enable web client 112 to communicate with other components, such as data processing and distribution component 107.

Further, in the example of FIG. 1, client 124 is a mobile client, which may exist on a device such as wireless telephone 130 or wireless-communications-enabled Personal Digital Assistant (PDA) 132, either of which may make use of a communications device such as modem 134 in order to enable mobile client 124 to communicate over a network such as the Internet. As with client 112, mobile client 124 may employ a JMS component 126 and/or an HTTP engine 128 to enable mobile client 124 to communicate with other components.

In a typical scenario, clients 112 and 124 submit data to data processing and distribution component 107, which is indicative of the type of alerts and other information that clients 112 and 124 would desire and/or need to receive. In one example, this information takes the form of an "objective." For example, mobile client 124 may be a PDA that will be taken with a soldier on patrol for IEDs, in which case the data communicated to data processing and distribution component 106 will be a statement of that objective, and the area in which the patrol will occur. Data processing and distribution component 107 then provides this information to context processing component 102, so that context processing component 102 (through the scoring mechanisms discussed above) can determine what data would be most relevant to the soldier and therefore needs to be pushed to the soldier in the form of an alert. The context engine 104 present at context processing component 102 then scores data that is known to context processing component 102 (or that becomes known to context processing component 102), and pushes the most relevant data out to mobile client 124 through data processing and distribution component 106.

The HTTP engines may be used to communicate objectives and other context information from the clients back to the context processing component—e.g., a user may use a browser to enter the information. For the alerts and other information to be sent back to the client, it may be desirable to send such alerts and other information using JMS. These mechanisms for transmitting information back and forth are merely examples; other mechanisms for transmitting the information may be used.

Figure 5:
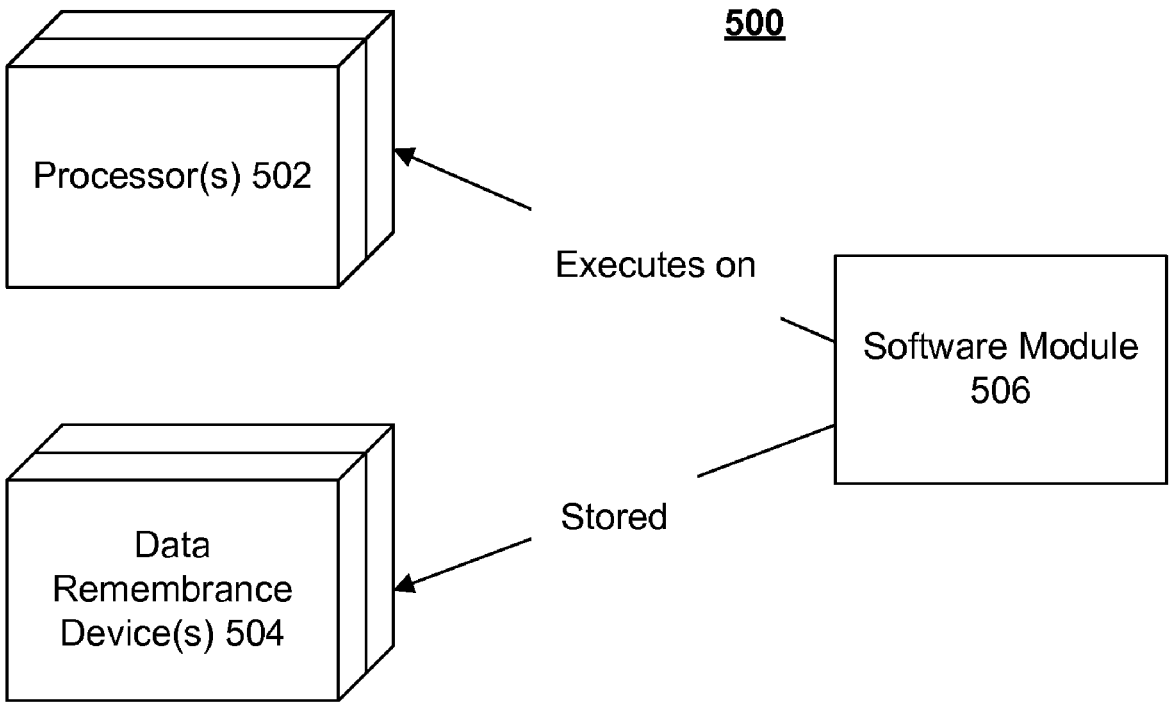
FIG. 5 is a block diagram of an example system in which aspects of the subject matter described herein may be implemented.

The various software components shown in FIG. 1 (e.g., scoring engines 106 and 108, the HTTP engines, and the JMS components) can be implemented as software modules that are storable in one or more data remembrance devices and that are executable on one or more processors, as in the example of FIG. 5 discussed below.

Example Process

Figure 2:
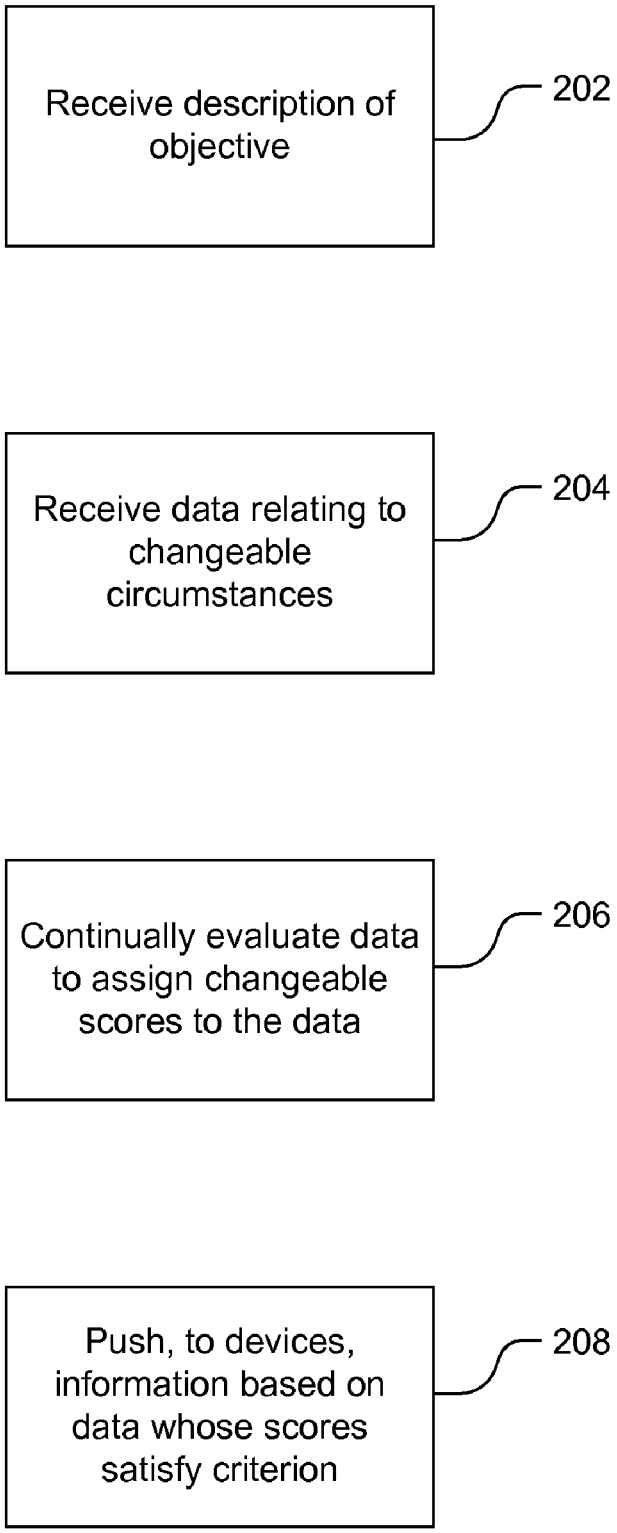
FIG. 2 is a flow diagram of an example process for providing alerts.

FIG. 2 shows, in flowchart form, an example process that may be used to implement the subject matter described herein.

At 202, a description of objectives is received. For example, one of clients 112 or 124 (shown in FIG. 1) may send an objective or other context information to context engine 104 (also shown in FIG. 1). The object or other context information may be sent, for example, through data processing and distribution component 106. The object or context information is received at context engine 104.

At 204, data is received that relates to changeable circumstances. Changeable circumstances may include, for example, locations of objects that can move, weather conditions, security conditions, or any other information. As discussed above, information can be collected on an ongoing basis, and the value of the information can change significantly depending on the age of the information (e.g., the last known position of a car may have little value if the position was recorded 24 hours ago), or whether the information is known to have changed (the position of a car, as recorded 24 hours ago, may be essentially worthless if more recent position information about the car has recently been received). When data exists that represents changeable circumstances, scoring engines 106 and 108 (shown in FIG. 1) may be useful in determining how valuable a given piece of data is.

Conceptually, a difference between the information received at 202 and the information received at 204 is that the information received at 202 represents what sort of alerts a particular client is interested in receiving, and the information received at 204 represents basic facts about which alerts can be generated. For example, the data received at 202 may state that a soldier is patrolling for IEDs in a particular geographic area. This is an example of a statement of objective. By contrast, the data received at 204 may constitute locations of recently exploded IEDs, or locations of cars that are believed to carry (or constitute) IEDs. These are examples of basic facts (i.e., data about basic facts about events that have occurred or are occurring).

At 206, data that have been received (i.e., the data received at 204, as described above) is continually evaluated to assign scores to the data. As noted above, the data represent changeable facts, and thus the scores assigned to the data may change. For example, data about the location of a particular object may be assigned a high score when it first arrives, but the score may be lowered as the data ages (and may drop to zero if information is subsequently received about the same object's new location). Similarly, data may be scored based on how closely it meets the objective that was communicated at 202, and this score may change depending on what objective is being processed by context engine 104 (shown in FIG. 1). For example, the location of a recently-exploded IED may receive a high score if the objective that is being considered is a search for IEDs, but may receive a low score if the objective being considered is different.

At 208, after data has been scored, then information such as alerts is pushed to client devices, based on data whose scores satisfy a particular criterion. For example, if data about past explosive events, locations of vehicles, etc., satisfy a particular criterion, then alerts based on that data can be pushed to client devices for which that information would be relevant (as indicated by the objective previously communicated from the client device). In one example, the information pushed out to the client device is the data itself (e.g., "an explosive event occurred at location X"). In another example, the alert is synthesized from the data (e.g., "there have been reports of multiple explosive events in your area in the past hour").

Examples of Changeable Data

As explained above, data that is communicated to context engine 104 may include data about changeable events, of which one example is data about the locations of objects that can move. An example of such objects, and the data relating to them, is shown with reference to FIGS. 3 and 4.

Figures 3, 4:
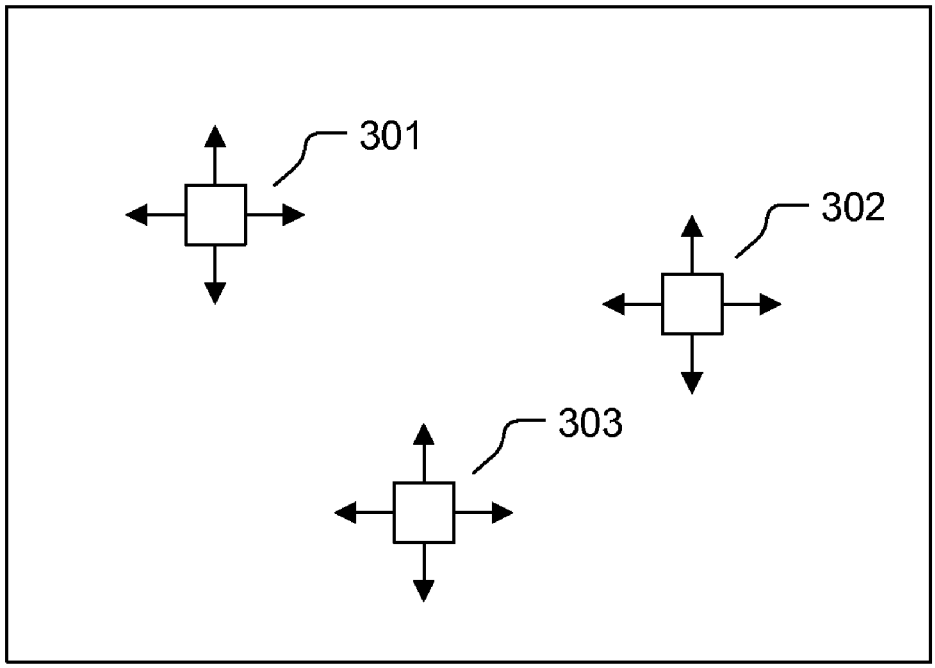
FIG. 3 is a block diagram of an example of objects that move.
FIG. 4 is a block diagram of an example set of data relative to moveable objects.

FIG. 3 shows objects 301, 302, and 303. As indicated by the arrows emanating from objects 301, 302, and 303, these objects are able to move in any direction. Thus, information about the object's location may have greater or lesser relevance depending on the age of the information.

FIG. 4 is a chart showing example data about the location of objects 301, 302, and 303. The data shown in the chart of FIG. 4 is an example of the type of data that may be received at item 204 (shown in FIG. 2). Each line in the chart shows the identifier for a particular object, a coordinate representing the location of the object, and a time at which the data was received. (The Cartesian coordinates shown in the middle column of the chart are, of course, just an example; data about an object's position can be represented in any manner.) As can be seen in the chart, each line in the chart shows where an object was at a particular time. Certain lines relate to the same object. The age of a given piece of data, or the fact that more recent information about the object was received, can be used by a scoring engine (e.g., scoring engines 106 and 108, shown in FIG. 1) to determine the relevance of a particular piece of data. For example, data that is old (as indicated by its time entry) may be given a relatively lower score. When multiple location data are received for the same object, the most recent piece of data may effectively supersede prior data for that object, thereby effectively lowering the relevance score for prior data to zero—if the information to be pushed out to clients is information about the object's last known location. On the other hand, if the information to be pushed out to clients is based on, say, a motion vector for a particular object, then old data about the object's position may not be deemed irrelevant, since such data can be used to calculate the apparent motion of the object. Other example uses of the data are possible, and none of the examples given should be viewed as limiting of the subject matter described herein.

Examples of Scoring

As noted above, one aspect of the subject matter disclosed herein is that data that has been collected can be scored to determine how relevant that data is to a particular objective. The following described various ways in which such scores can be created and used.

In one example, the score for a particular piece of data is a simple scalar value, such that data having a high scalar value is presumed to be more relevant than data having a low scalar value. In greater generality, the score can be some type of vector representing more than one dimension; for these more complex scores, an algorithm can be created to compare two scores in order to determine which one represents a higher relevance.

As noted above, the relevance score for an object can be based on some pre-defined factor (e.g., the score for an object can decrease with age), or the score can be based on how relevant the data is to a particular objective that has been registered by a client.

In another example, scoring can be adaptive—i.e., the scoring engines can learn how well their scoring algorithms identify the most relevant information, and can adapt accordingly. For example, when alerts are pushed out to clients, the clients can provide feedback on how consistent the information contained in the alert is with reality, and the criteria on which scoring decisions are based can then be adjusted at the scoring engines accordingly.

Example Implementations

The subject matter described herein can be deployed in the form of program code that executes on a computer or other type of computing device. The subject matter can be deployed using existing components, such as display monitors and computers that have processors and data remembrance devices, and the way in which such deployment of the novel subject matter can be performed will be apparent to those of ordinary skill in the relevant area.

Program code to implement the functionality described herein can be stored on one or more computer-readable media (e.g., optical or magnetic disk, tape, semi-conductor memory, etc.), and then loaded into the computing device that performs such functionality. The use of such media to store and load such program code is generally known in the relevant field.

Aspects of the subject matter described herein may be deployed in an apparatus that comprises one or more processors (e.g., one or more central processing units), and/or one or more data-remembrance devices (e.g., disks, tapes, semiconductor memories, etc.). For example, a module may be implemented in the form of such an apparatus, by storing program code in one or more of the data-remembrance devices, and by causing the stored code to execute on one or more of the processors. FIG. 5 shows an example of this arrangement in the form of a system 500. System 500 comprises one or more processor 502 and one or more data remembrance devices 504. A software module 506 is stored (or storable) in one or more of data remembrance device 504, and is executable on one or more of processors 502. Processors 502 and data remembrance devices 504 are communicatively linked in such a way that the instructions in software module 506 can be communicated between them.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A system comprising:

a processor;

a data remembrance device;

a module that comprises instructions that are stored in said data remembrance device and that are executable on said processor, wherein said instructions when executed cause said system to perform operations comprising:

receiving information that identifies what type of alert a user is interested in receiving, wherein said user is associated with a particular geographic area;

collecting instances of data comprising time-dependent information, said instances of data comprising a first instance of data;

associating a time-dependent score with said first instance of data according to relevance of said first instance to said type of alert and to said geographic area; and sending an alert to a mobile device accessible by said user if said score satisfies a criterion.

2. The system of claim 1, wherein said criterion comprises a threshold, such that said criterion is satisfied by those instances of said data whose scores exceed said threshold.

3. The system of claim 1, wherein said time-dependent score changes according to said time-dependent information.

4. The system of claim 1, wherein said instances of data comprise locations at which explosive devices have detonated.

5. The system of claim 4, wherein said alert sent to said device comprises an indication of areas at which undetonated explosive devices are likely to be found.

6. The system of claim 4, wherein said instances of data comprise times at which said explosive devices have detonated.

7. The system of claim 1, wherein said operations further comprise:

receiving feedback about said alert; and selectively adjusting said score and said criterion based on said feedback.

8. The system of claim 1, wherein said alert comprises said first instance of data.

9. The system of claim 1, wherein said alert comprises information synthesized from said instances of data.

10. One or more computer-readable storage media having computer-executable instructions to perform a method, said method comprising:

receiving information that identifies what type of alert a user is interested in receiving, wherein said user is associated with a particular geographic area;

collecting instances of data comprising time-dependent information, said instances of data comprising a first instance of data;

associating a time-dependent score with said first instance of data according to relevance of said first instance to said type of alert and to said geographic area; and sending an alert to a mobile device accessible by said user if said score satisfies a criterion.

11. The one or more computer-readable storage media of claim 10, wherein said criterion comprises a threshold, such that said criterion is satisfied by those instances of said data whose scores exceed said threshold.

12. The one or more computer-readable storage media of claim 10, wherein said time-dependent score changes according to said time-dependent information.

13. The one or more computer-readable storage media of claim 10, wherein said instances of data comprise locations at which explosive devices have detonated.

14. The one or more computer-readable storage media of claim 13, wherein said instances of data comprise times at which said explosive devices have detonated.

15. The one or more computer-readable media of claim 10, wherein said method further comprises:

receiving feedback about said alert; and selectively adjusting said score and said criterion based on said feedback.

16. The one or more computer-readable storage media of claim 10, wherein said alert comprises said first instance of data.

17. The one or more computer-readable storage media of claim 10, wherein said alert comprises information synthesized from said instances of data.

18. A computer-implemented method comprising:

receiving information that identifies an objective of a user, wherein said user is associated with a particular geographic area;

accessing instances of data comprising information, said instances of data comprising a first instance of data having a time value associated therewith;

determining a score for said first instance of data according to relevance of said first instance to said objective, its proximity to said geographic area, and its age;

sending an alert to a mobile communication device of said user if said score satisfies a criterion;

receiving feedback about said alert; and selectively adjusting said score and said criterion based on said feedback.

19. The method of claim 18, wherein said instances of data comprise locations at which explosive devices have detonated.

20. The method of claim 19, wherein said alert sent to said mobile device comprises an indication of areas at which undetonated explosive devices are likely to be found.

21. The method of claim 19, wherein said instances of data comprise times at which said explosive devices have detonated.

* * * * *